US007570771B2

(12) United States Patent
Whitwell et al.

(10) Patent No.: US 7,570,771 B2
(45) Date of Patent: Aug. 4, 2009

(54) LOUDSPEAKERS

(75) Inventors: Timothy Christopher Whitwell, Huntingdon (GB); Nicholas Patrick Roland Hill, Huntingdon (GB); Geoffrey Arthur Coleridge Boyd, Huntingdon (GB)

(73) Assignee: New Transducers Limited, Huntingdon, Cambs (GB)

( * ) Notice: Subject to any disclaimer, the term of this patent is extended or adjusted under 35 U.S.C. 154(b) by 172 days.

(21) Appl. No.: 10/592,279

(22) PCT Filed: Mar. 2, 2005

(86) PCT No.: PCT/GB2005/000824

§ 371 (c)(1),
(2), (4) Date: Nov. 20, 2006

(87) PCT Pub. No.: WO2005/089014

PCT Pub. Date: Sep. 22, 2005

(65) Prior Publication Data

US 2007/0206822 A1 Sep. 6, 2007

Related U.S. Application Data

(60) Provisional application No. 60/558,103, filed on Apr. 1, 2004.

(30) Foreign Application Priority Data

Mar. 11, 2004 (GB) ..... 0405475.5

(51) Int. Cl.
*H04R 25/00* (2006.01)

(52) U.S. Cl. ..... 381/152; 381/333; 381/388

(58) Field of Classification Search ..... 381/152, 381/306, 89, 332, 333, 386, 388, 398, 423, 381/424, 431, 337, 353, 354, 162; 361/681, 361/682, 683, 686

See application file for complete search history.

(56) References Cited

U.S. PATENT DOCUMENTS

| | | | | |
|---|---|---|---|---|
| 5,025,474 | A * | 6/1991 | Tanaka et al. | 381/333 |
| 5,930,376 | A * | 7/1999 | Markow et al. | 381/333 |
| 6,188,775 | B1 | 2/2001 | Azima et al. | |
| 2001/0026625 | A1 * | 10/2001 | Azima et al. | 381/152 |
| 2002/0172393 | A1 | 11/2002 | Bank et al. | |

FOREIGN PATENT DOCUMENTS

| | | | |
|---|---|---|---|
| WO | WO 98/52381 | A2 | 11/1998 |
| WO | WO 99/37121 | A1 | 7/1999 |
| WO | WO 00/02417 | A1 | 1/2000 |
| WO | WO 02/104065 | A2 | 12/2002 |

* cited by examiner

*Primary Examiner*—Huyen D Le
(74) *Attorney, Agent, or Firm*—Roylance, Abrams, Berdo & Goodman, L.L.P.

(57) ABSTRACT

A loudspeaker comprising a bending wave panel-form acoustic radiator having a first portion and at least one further portion a transducer for exciting bending waves in the radiator, the transducer being coupled to the further portion of the radiator to cause the radiator to radiate an acoustic output, and means confining low frequency radiation to the further portion of the radiator.

10 Claims, 3 Drawing Sheets

LOUDSPEAKERS

This application claims the benefit of U.S. provisional application No. 60/558,103, filed Apr. 1, 2004.

TECHNICAL FIELD

This invention relates to bending wave panel loudspeakers, and more particularly, but not exclusively to such loudspeakers combined with visual display screens.

BACKGROUND ART

International Application WO 00/02417 describes a loudspeaker comprising a visual display screen, a panel-form member positioned adjacent to the display screen and at least a portion of which is transparent and through which the display screen is visible, and a vibration exciting transducer mounted to an edge or marginal portion of the panel-form member to apply energy to the panel-form member to cause the panel-form member to act as an acoustic radiator, characterized in that the panel-form member is arranged to be resonant at audio frequencies, in that the vibration transducer is adapted to apply bending wave energy to the panel-form member to cause it to resonate to act as an acoustic radiator when resonating and in that one or more marginal portions of the panel-form member are clamped or restrained. This arrangement has a number of advantages, including:

1) Minimizing the footprint of the loudspeaker in a given application.

2) Improved user experience, where the image and sound come from the same location.

3) Ability to reproduce stereo from two spatially separated channels on the same plate.

International Application WO 99/37121 describes methods for excitation of a panel-form bending wave radiator, e.g. a transparent plate, including choice of exciter location to optimize the distribution of excited modes for a smooth transfer of energy.

The design of a display system based on this prior art can be limited at low frequency for the following two reasons:

1. The low frequency limit for useful radiation from the plate is determined by the gap between the plate and the screen. The cavity formed behaves as a distributed compliance, which together with the areal density of the plate forms a mass spring resonance. Below this resonance frequency the modes excited in the plate radiate only weakly, whereas above this frequency useful modal radiation may be achieved, and 2. A second parameter that controls the effective low frequency limit for the system is the visibility of vibrations on the plate. For a high quality visual display visual vibration can be unacceptable. The most dominant effect is the visibility of reflections from the plate, rather than any disturbance of the direct image of the screen. This may be minimized with control over the environment in which the unit is used, such as lowering the light level in the room, or angling the screen to minimize the visibility of reflections from light sources in the room. Anti-reflection coatings on the plate may improve the performance. In many applications, however, there is no direct control over these environmental factors, and this problem can be severe.

The visibility of vibration gives an alternative low frequency limit for the useful bandwidth over which a transparent loudspeaker in front of a screen may be used. The limit is manifest as a maximum level at a given low frequency energy. The limit becomes more severe at progressively low frequencies below approximately 250 Hz. The figure of ~250 Hz is controlled by the sensitivity of the human visual system. The vibrations above this frequency are progressively lower in amplitude (for a given SPL) and vary at a higher rate. The human visual system averages out these fluctuations and the visibility of vibration is markedly reduced.

The prior art therefore discloses a transparent loudspeaker, optimized for its distribution of excited modes, which provides a high quality sound output above a low frequency limit. The low frequency limit is determined both by the depth of the cavity and the visibility of vibration. This limits the useful sound output to ~250 Hz for display systems of the highest quality.

DISCLOSURE OF INVENTION

According to the invention, there is provided a loudspeaker comprising a bending wave panel-form acoustic radiator having a first portion and at least one further portion, a transducer for exciting bending waves in the radiator, the transducer being coupled to the further portion of the radiator to cause the radiator to radiate an acoustic output, and means confining low frequency radiation to the further portion of the radiator.

The loudspeaker may comprise a visual display screen, and the first portion of the radiator may be transparent and may be positioned adjacent to the display screen to be visible through the first portion.

The display screen and the first portion of the radiator may be separated by a relatively narrow gap of for example 2 mm or less and the loudspeaker may comprise a rear enclosure disposed adjacent to the further portion of the radiator and separated from the further radiator portion by a relatively large gap e.g. of 10 mm or more.

The loudspeaker may comprise means terminating the radiator and adapted to generate a system resonance such that the associated vibration is focused in the further portion of the radiator.

The loudspeaker may comprise a frequency dependent termination separating the first and further portion of the radiator. The frequency dependent termination may be of plastics foam. The plastics foam may provide a dust seal.

The radiator may be arranged to be resonant at audio frequencies, and the transducer adapted to apply bending wave energy to the radiator to cause it to resonate to act as an acoustic radiator when resonating.

The radiator may comprise a plurality of further portions to each of which one or more transducers is coupled to cause the radiator to radiate an acoustic output, the arrangement being such that the resonant modes of the plurality of further portions are distributed in frequency.

This invention thus provides an improved transparent bending wave loudspeaker for use in front of a display system. Features of the invention are as follows:

1) A single radiating plate where a first portion of the plate is transparent and is situated in front of the screen.

2) At least one further portion of the plate that is located beyond the screen, separated from the plate by a mechanical termination. This may be referred to as the second portion, but no limitation to only two portions is implied.

3) Increased volume (per unit area) of air behind the second portion of the screen. This is possible as this region is outside the area of the display area.

4) Excitation of the plate at least at one point over the second portion of the screen. Note this could be combined with excitation at multiple points over the second portion or other locations.

5) Optimization of the mechanical properties of the termination between the two portions of the screen. The purpose of this optimization is to confine low frequency energy to predominantly the second portion, allowing energy at higher frequencies to pass into the first (transparent) portion.

The outcome is improved useful low frequency bandwidth from the device. Firstly the low frequency capability of the device is improved, due to the larger volume per unit area behind the second portion. Secondly, the concentration of low frequency energy away from the screen area minimizes the visibility of vibration at low frequencies, and the full capability of the system is used without being prematurely limited by such visual effects. The surface of the second portion may also be designed to minimize visual vibration, e.g. a matt surface finish.

BRIEF DESCRIPTION OF DRAWINGS

The invention is diagrammatically illustrated, by way of example, in the accompanying drawings, in which.

BEST MODES FOR CARRYING OUT THE INVENTION

Figure 1:
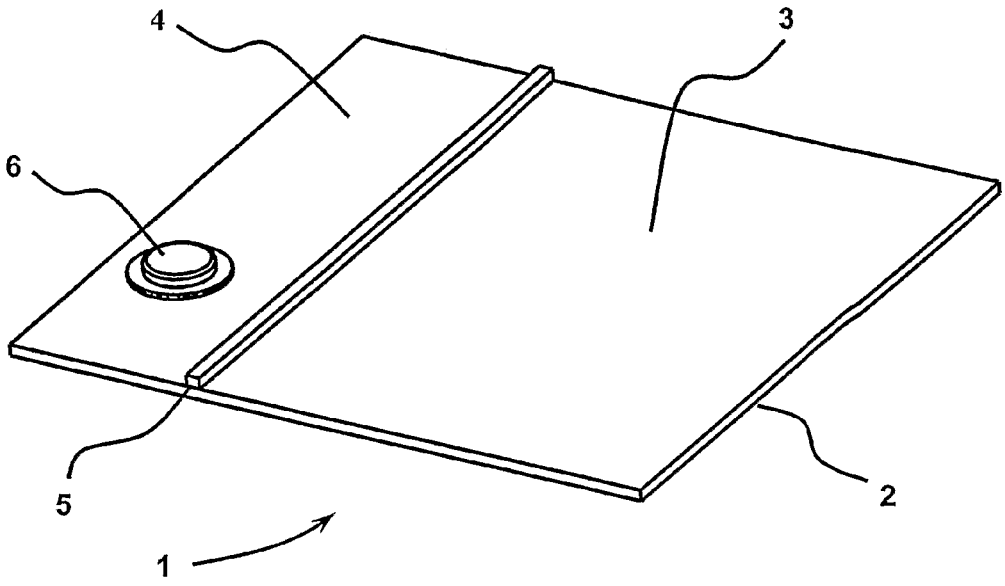
FIG. 1 is a perspective view of a first embodiment of panel-form loudspeaker of the present invention.

FIG. 1 shows a generally rectangular panel-form bending-wave loudspeaker (1) generally of the kind described in International Patent Application WO97/09842 and wherein the panel radiator (2) is divided into two portions or regions (3,4), that is a first portion or region 1 indicated by reference numeral (3) and a further portion or region 2 indicated by reference numeral (4), by a strip-like mechanical impedance divider (5) of a foam plastics material. The divider (5) extends across the panel from side to side such that region 2 is relatively small compared to region 1. A vibration exciter (6) is coupled to region 2 to apply bending wave energy thereto to cause the radiator to resonate and radiate an acoustic output in response to a signal applied to the exciter in the normal manner. However, in accordance with the invention, low frequency bending waves are confined to region 2 by the divider (5) and, as explained below, the nature of the divider is arranged to be such that high frequency energy can pass into region 1 of the radiator.

Thus region 1 may be made transparent and placed adjacent to a display screen (not shown in FIG. 1 but see FIG. 2 below) so that the display screen is viewed through the region 1 portion of the radiator panel so that the image and sound come from the same location. Also, in this way, relatively large panel excursions in region 2 due to low frequency excitation are not a visual distraction to the observer of the visual display viewed through region 1.

Figure 2:
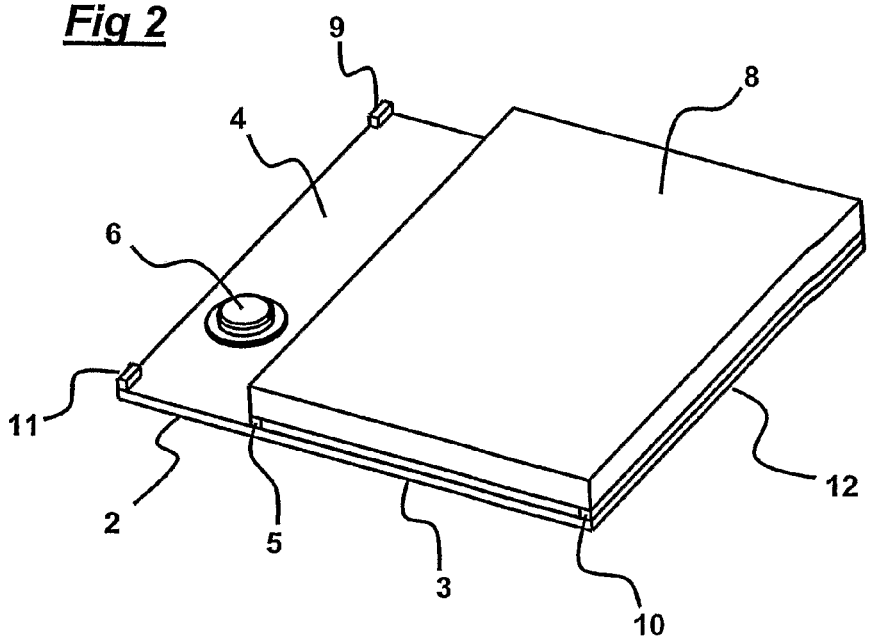
FIG. 2 is a perspective view of a second embodiment of panel-form loudspeaker of the present invention and which is generally similar to that of FIG. 1.

As shown in FIG. 2, region 1, which, as explained above, is transparent, can have a VDU enclosure housing (8) mounted adjacent thereto, such that a visual display screen or unit is visible through the radiator.

The corners (11) of the radiator disposed in region 2 may be suspended on resilient foam plastics suspension members (9) fixed to a supporting structure (not shown) and the opposing edge (12) of the radiator may be suspended on a resilient foam plastics strip suspension (10).

Figure 3:
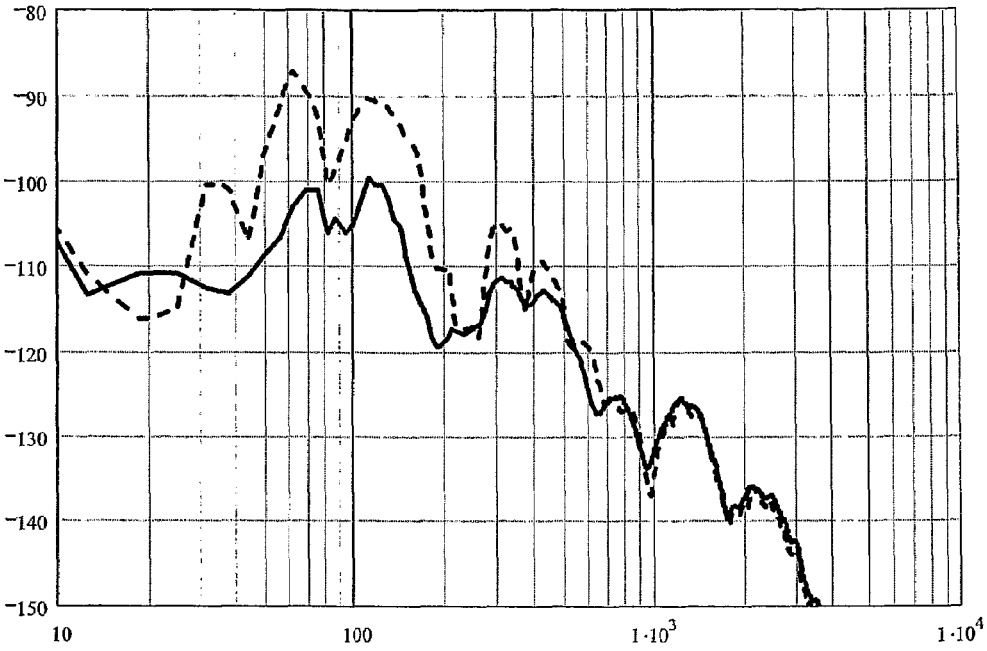
FIG. 3 is a graph showing mechanical excursion of the panel with frequency at the centre of the first portion, shown on a log (decibel) scale.
Figure 4:
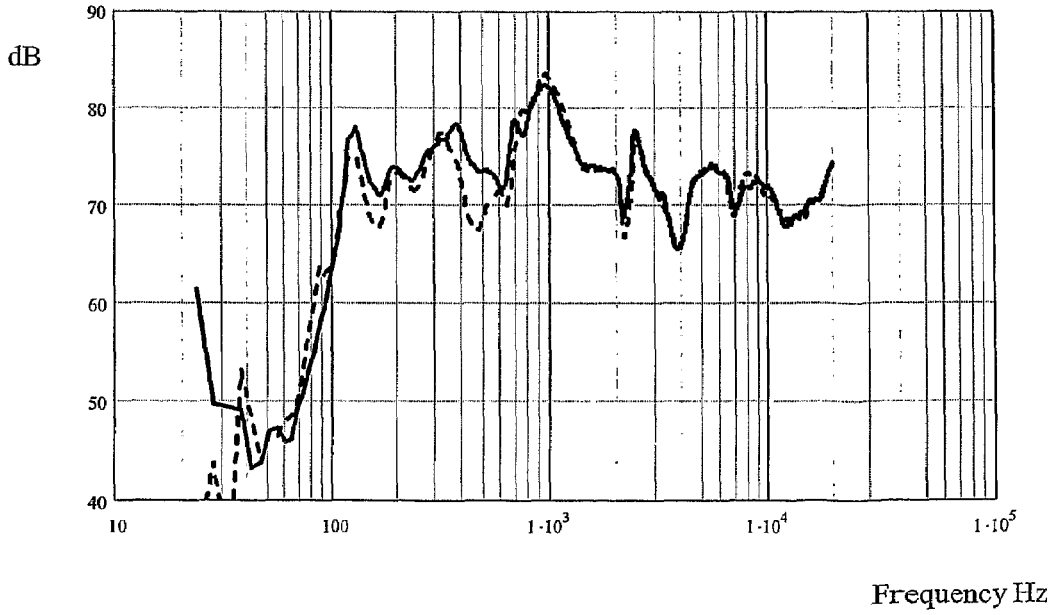
FIG. 4 is a graph of frequency response (sound pressure level with frequency) of a loudspeaker with (dash line) and without (solid line) an impedance divider.

FIG. 3 is a graph illustrating the effect of the mechanical impedance divider in confining low frequency vibration to region 2 of the panel radiator. The solid line in the graph shows the mechanical excursion of panel with frequency with the mechanical impedance divider in place, and the dashed line shows the mechanical excursion with frequency without the divider. As illustrated in FIG. 4, it is to be noted that the overall performance of the loudspeaker of FIG. 1 is not significantly affected by the use of the divider.

Figure 5:
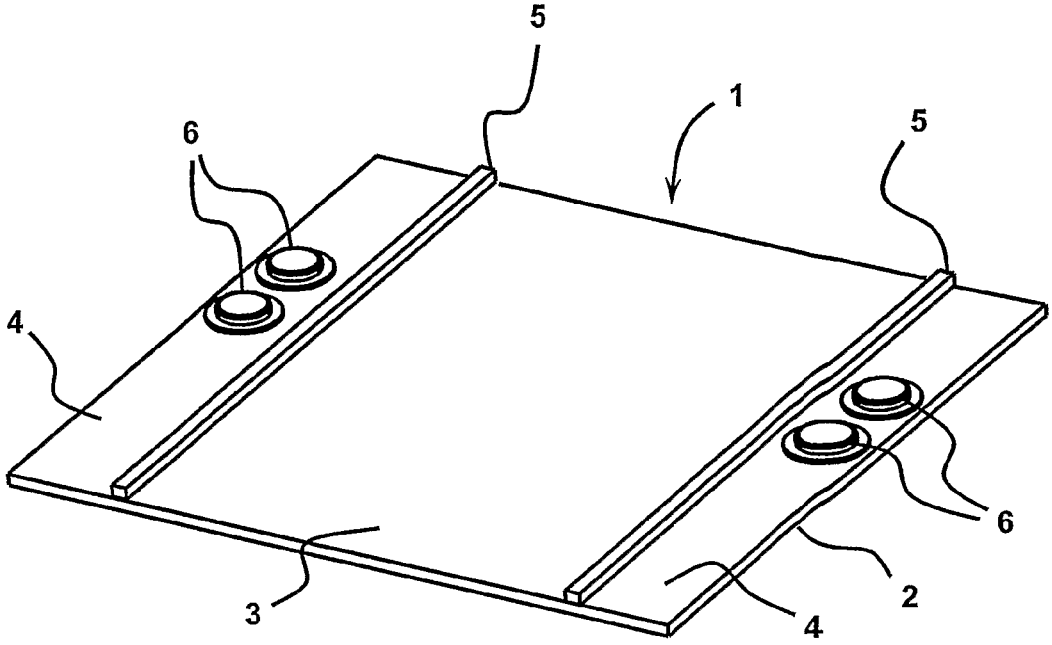
FIG. 5 is a perspective view of a second embodiment of loudspeaker.

Referring to FIG. 5, there is shown a generally rectangular panel-form bending-wave loudspeaker (1) very similar to that of FIG. 1, but which has two further regions (4) on opposed sides of the radiator (2) and in between which is a single transparent first region (3). The first region 3 is separated from the two further regions (4) by impedance dividers (5). Each of the further regions (4) has a pair of vibration exciters (6) coupled thereto.

The arrangement shown in FIG. 5 might be used in conjunction with a liquid crystal display television.

An example of a suitable termination or mechanical impedance divider is a foam plastics strip that provides a mechanical impedance termination over a line. The mechanical impedance divider may be constructed of plastics foam strip where the properties of implied compliance and mechanical resistance are pertinent. These are bulk properties of the selected material, and for example Miers Foam at 3 mm thick has a compliance of 1×10^−8 M^3/N and a resistance of 1.2×10^4 Ns/m^3. In the application the width and thickness of the strip is relevant plus the choice of material. The related parameters are chosen to define the high pass frequency dividing function of the mechanical impedance in relation to the size of the panel, its mechanical impedance and the required dividing frequency.

The properties of the plastics foam may include a resistance and a compliance. The properties of the termination are optimized to limit the transfer of energy into the plate at low frequencies, confining the vibration predominantly to the further or second portion, that is region 2.

The mechanical impedance of a foam increases as the frequency is decreased, and generally dominates over the plate impedance below a given frequency. The plate impedance over a line is also an increasing function with reducing frequency, though this generally has a slower square root dependence, as opposed to the linear dependence of most foams. At low frequencies the foam impedance dominates and the termination approximates a simple support. As the frequency increases the plate impedance decreases at a slower rate than the foam, which therefore decouples from the plate and energy may propagate freely into the plate. In between these two regions the foam may be an effective absorber. The frequency ranges and the level/bandwidth of the absorption are controlled with the resistance and compliance of the foam. These may be controlled as a function of frequency with different foam formulations.

This simple situation will limit the transfer of energy at low frequencies and allow transfer of energy at high frequencies. However, energy will still pass between the two regions at low frequencies due to rotation about the pivot. Good separation may be achieved over a narrow frequency band, however extending this wider may be problematic. This example may be extended to the use of additional control over the termination of the plate, in particular the termination of the edge of the plate (around the second portion). This may either achieve a wider bandwidth of separation, or alternatively be used to create and tune a system resonance where the vibration is focused in the second portion. One or more resonances associated with the second portion may be used to provide the additional low frequency radiation required for the system. If multiple further portions or areas away from the visible area of the plate are used, e.g. as shown in FIG. 5, then their frequencies may be distributed, e.g. in the manner described in International application WO 97/09842. Reasons for having more than one further portion or area are [1] to provide multi channel output, such as stereo, [2] to increase the radiating area and therefore reduce voice coil excursion and panel displacement for a given output level, and [3] to satisfy specific design requirements or product layouts.

The invention claimed is:

1. A loudspeaker comprising a bending wave panel-form acoustic radiator having a first portion and at least one further portion, said one further portion being relatively small compared to said first portion, a transducer for exciting bending waves in the radiator, the transducer being coupled to the at least one further portion of the radiator to cause the radiator to radiate an acoustic output, and an impedance divider confining low frequency radiation to the at least one further portion of the radiator and wherein the properties of the impedance divider are optimised to limit transfer of energy at low frequencies and to allow transfer of energy at high frequencies with good separation being achieved over a narrow frequency band.

2. A loudspeaker according to claim 1, comprising a visual display screen, the first portion of the radiator being transparent and being positioned adjacent to the display screen to be visible through the first portion and the further portion being laterally displaced from the display screen.

3. A loudspeaker according to claim 2, wherein the display screen and the first portion of the radiator are separated by a relatively narrow 20 gap and comprising a rear enclosure disposed adjacent to the further portion of the radiator and separated from the further radiator portion by a relatively large gap.

4. A loudspeaker according to anyone of claims 1, 2 and 3, a termination for the radiator adapted to generate a system resonance such that the associated vibration is focused in the further portion of the radiator.

5. A loudspeaker according to claim 1, comprising a frequency dependent termination separating the first portion and the further portion of the radiator.

6. A loudspeaker according to claim 5, wherein the frequency dependent termination is of plastics foam.

7. A loudspeaker according to claim 6, wherein the plastics foam provides a dust seal.

8. A loudspeaker according to claim 1, wherein the radiator is arranged to be resonant at audio frequencies, and wherein the transducer is adapted to apply bending wave energy to the radiator to cause it to resonate to act as an acoustic radiator when resonating.

9. A loudspeaker according to claim 8, wherein the radiator comprises a plurality of further portions to each of which a transducer is coupled to cause the radiator to radiate an acoustic output.

10. A loudspeaker according to claim 9, wherein the arrangement is such that the resonant modes of the plurality of further portions are distributed in frequency.

* * * * *